US005797653A

United States Patent [19]

Elzenbeck et al.

[11] Patent Number: 5,797,653

[45] Date of Patent: *Aug. 25, 1998

[54] CHAIR, IN PARTICULAR OFFICE CHAIR

[75] Inventors: Manfred Elzenbeck, Steinheim/Murr; Klaus Haar, Weinstadt; Harald Nathmann, Worms, all of Germany

[73] Assignee: Dauphin Entwicklungs - u. Beteiligungs-GmbH, Neukirchen, Germany

[ * ] Notice: The term of this patent shall not extend beyond the expiration date of Pat. No. 5,564,783.

[21] Appl. No.: 277,275

[22] Filed: Jul. 21, 1994

[30] Foreign Application Priority Data

Jul. 22, 1993 [DE] Germany ..... 43 24 542.0

[51] Int. Cl.[6] ..... A47C 3/00

[52] U.S. Cl. ..... 297/300.5; 297/300.6

[58] Field of Search ..... 297/285, 301, 297/300, 304, 305, 300.1, 300.2, 300.4, 300.6, 300.7, 300.8, 302.1

[56] References Cited

U.S. PATENT DOCUMENTS

| | | |
|---|---|---|
| 3,656,593 | 4/1972 | Bauer . |
| 4,200,332 | 4/1980 | Bränning . |
| 4,641,886 | 2/1987 | Dauphin . |

FOREIGN PATENT DOCUMENTS

| | | | |
|---|---|---|---|
| 0105180 | 4/1984 | European Pat. Off. . | |
| 281845 | 9/1988 | European Pat. Off. | 297/301 |
| 539733 | 5/1993 | European Pat. Off. | 297/301 |
| 2533428 | 3/1984 | France | 297/301 |
| WO2536 | 5/1986 | WIPO | 297/301 |

*Primary Examiner*—Milton Nelson, Jr.
*Attorney, Agent, or Firm*—Browdy and Neimark

[57] ABSTRACT

A chair, in particular an office chair, has a so-called synchronous mechanism in the form of a front seat support member stationary in relation to a chair column and a rear seat support member pivotable about a pivot axle in relation to the front seat support member and bearing a back-rest. A seat supports itself on the two seat support members. A blocking lever of a blocking mechanism and having a stop face is articulated on the rear seat support member at a distance from the pivot axle. This stop face is moved by gravity into engagement with a blocking face stationary in relation to the front seat support member. For releasing this locking, the blocking lever is lifted by a blocking actuator arm.

8 Claims, 6 Drawing Sheets

26
22
30
29
20
35
19
21
27
IV
23
V
28
19'
9
20'
25
24
32
33
31
34
48
6
8
5
7
4
50
49
54
51
37
36
42
43
41
39
68
66
62
61
67
67a
40
38
IV
V
28
67
66
61
64
62
68
67a
70
69
65
6
58
8
7
53
63
37
18

CHAIR, IN PARTICULAR OFFICE CHAIR

BACKGROUND OF THE INVENTION

1. Field of the Invention

The invention relates to a chair, in particular an office chair, comprising a pedestal, a chair column projecting upwards from the pedestal, a seat support supported on the chair column and having a front seat support member joined to the chair column and a rear seat support member joined to the front seat support member by way of a pivot axle, a seat pivotably supported on the seat support members, a back-rest secured to the rear seat support member, an energy storing device, of which one end is positioned on the front seat support member by means of a pivot hinge and of which the other end is pivotably supported on the rear seat support member at a distance from the pivot axle, and a blocking mechanism for arresting the rear seat support member in relation to the front seat support member.

2. Background Art

A chair of the generic type known from U.S. Pat. No. 4,200,332 has a so-called synchronous mechanism, in which the back and the seat are simultaneously pivoted in a certain pre-set relation. The energy storing device serves to make the adjustment or pivoting of the back possible in that the user presses against the back. Upon this, the rear portion of the seat is lowered or it is raised if the back is pivoted forwards. A longitudinally adjustable gas spring to be fixed in any desired adjustment of length is provided for fixing the back and the seat in a position. This requires some expenditure.

A chair of the generic type is known from U.S. Pat. No. 4,641,886, in which the energy storing device is a gas spring not fixable in length, of which the housing is clampable for arresting the position of the rear seat support member relative to the front seat support member. In terms of construction, this design is comparatively simple.

A chair with a seat is known from EP 0 105 180 B1 to have a back linked with the seat flexibly or by articulation. A spring is provided loading the back in the sense of an upright position. Further, a frame is provided in which a horizontal front bearing pipe is arranged, on which the seat is arranged by articulation in the vicinity of its front edge. Further, a horizontal bearing shaft located at a distance below the seat is positioned in the frame, a supporting lever supporting the back by articulation approximately at lumbar level being rigidly connected with the bearing shaft. The back has at least one radially protruding cam. Further, a locking lever is articulated on the frame, which is attached by a transmission member to an actuating pipe passing through the front bearing pipe and being rotatable by an actuating lever and which is pivotable as a lock into the path of the cam. The bearing pipe is provided with an oblong hole extending in the circumferential direction for the passage of a peg which protrudes radially from the actuating pipe and on which the transmission member is articulated. Two actuating pipes that can exercise two functions can be positioned in the bearing pipe.

SUMMARY OF THE INVENTION

It is an object of the invention to embody a chair of the generic type such that given an extremely simple structure, a reliable, troublefree and comfortable operation is ensured.

According to the invention this object is solved in that the blocking mechanism has a blocking lever articulated on the rear seat support member at a distance from the pivot axle by means of a pivot joint and provided with a stop face which is pivotable into bearing engagement with a blocking face stationary relative to the front seat support member and releasable from this bearing engagement by means of a blocking actuator arm. The blocking lever and consequently the rear seat support member are locked in that a stop face of the blocking lever is engageable to bear against a blocking face stationary relative to the front seat support member. There is no need of clamping devices susceptible to wear.

The configuration according to which the stop face is turned away from the pivot joint and the blocking face is turned toward the pivot point, ensures that the locking is produced by the pressure of the stop face against the blocking face. Consequently, the locking is possible when the back is in a position pivoted forward as far as possible.

The locking takes place by gravity as a result of the further development according to which the blocking lever is pivotable upwards out of the bearing engagement of the stop face with the blocking face. The blocking lever only has to be lifted to release the locking. This is realized in a particularly advantageous and inventive way by the blocking actuator arm engaging from below an end of the blocking lever turned away from the pivot joint to release the bearing engagement of the stop face with the blocking face, by the blocking actuator arm being arranged on an actuating shaft which is pivotably arranged in a suspension tube supporting the seat in the vicinity of the front edge of the seat, by the blocking actuator arm being T-shaped with a transverse web engaging the blocking lever from below, and by the blocking lever having a forked end which faces the blocking actuator arm and with which the blocking actuator arm engages.

An exemplary embodiment of the invention will be specified below taken in conjunction with the drawing.

DESCRIPTION OF THE PREFERRED EMBODIMENT

Figure 1:
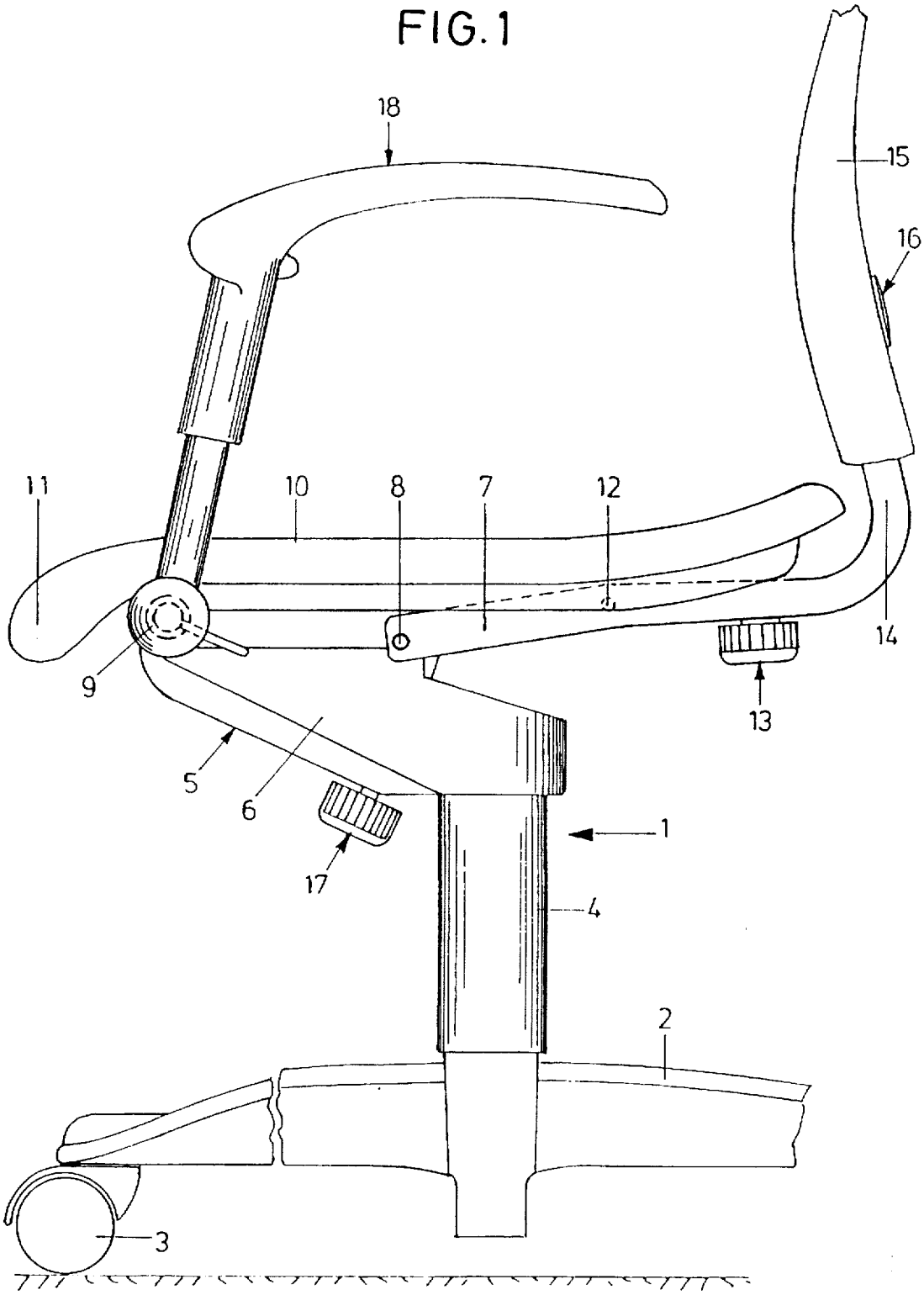
FIG. 1 is a perspective overall view of a chair.

FIG. 1 illustrates an office chair having a chair stand 1. The latter is provided with a pedestal 2 supported by castors 3 on the ground. An adjustable height chair column 4 is installed on the pedestal and has a seat support 5 secured to its upper end. The seat support 5 is of two-piece design; it has a front seat support member 6 mounted on the chair column 4 and a rear seat support member 7 articulated on the front seat support member above the chair column 4 by means of a pivot axle 8. A suspension tube 9 extending parallel to the pivot axle 8 is secured in the front portion of the front seat support member 6. Right behind its front edge 11, a seat 10 supports itself on this suspension tube 9. The rear portion of the seat 10 is supported on a supporting axle 12 positioned in the rear seat support member 7. Further, a seat pitch adjuster 13 can be arranged on the rear seat support member 7.

A back-rest support 14, on which a back-rest 15 is arranged, is formed in one piece with the rear seat support member 7 and projects upwards from the latter. A back-rest height adjuster 16 is provided for the height of the back-rest 15 to be adjusted in relation to the seat 10.

The specified configuration of the seat support 5 with the arrangement of the seat 10 and the back 15 forms a so-called synchronous mechanism. A force variation equipment 17 is provided for the forces to be varied that are to be overcome during adjustment or balancing. Armrests 18, of which only one is to be seen in the lateral view of FIG. 1, are arranged adjacent to the front edge 11 of the seat 10, namely on the outer ends of the suspension tube 9.

Figures 2, 3, 5:
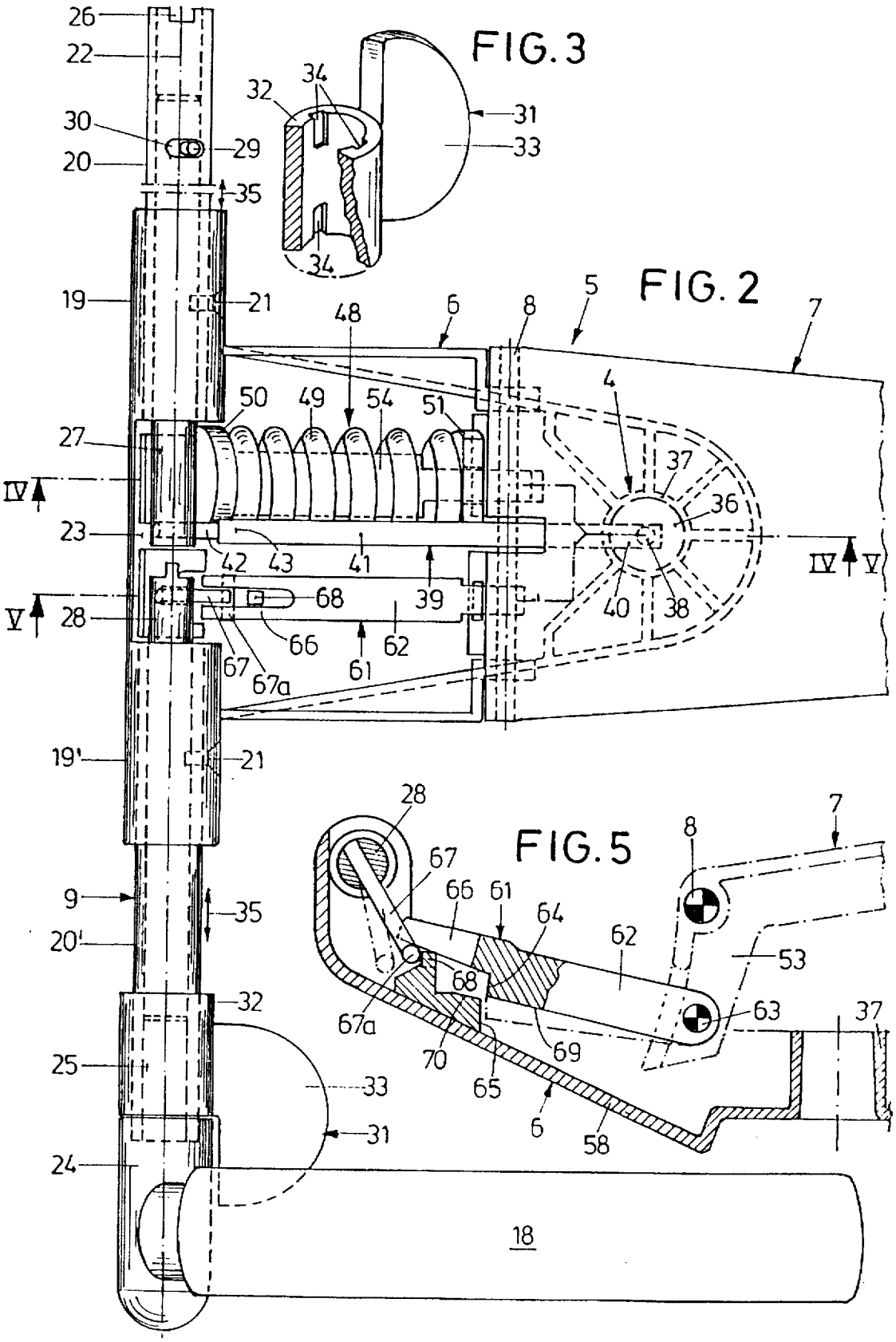
FIG. 2 is a partial plan view of a seat support of the chair of FIG. 1.
FIG. 3 is a perspective view of an operating lever for the chair.
FIG. 5 is a partial vertical section through the chair in accordance with the line V—V of FIG. 2.

As seen in FIG. 2, two bearing bushes 19, 19' in alignment with each other are formed in one piece with the front seat support member 6; two suspension tube sections 20, 20' forming the suspension tube 9 are positioned in alignment with each other in the bearing bushes 19, 19' and retained non-rotatably by means of a screw 21 and non-displaceably in the direction of the axis 22 of the suspension tube 9. The suspension tube sections 20, 20' only project outwards beyond the bearing bushes 19, 19'. Between the bearing bushes 19, 19'—and thus between the suspension tube sections 20, 20'—there is a substantially open chamber 23.

It is also roughly outlined in FIG. 2, bottom, that the armrest 18 is provided at its lower end with a short retaining socket 24 which is placed on to the end of the suspension tube section 20'. A retaining pin 25 engaging with the suspension tube section 20' is formed in the retaining socket 24 and joined to the latter. A screw not shown in the drawing is provided for arresting the retaining socket 24 in the direction of the axis 22. Positioning projections not shown in the drawing, which engage with recesses formed on the end of the respective suspension tube section 20, are formed in the retaining socket 24 as a safeguard against rotation of the armrest 18 in relation to the axis 22.

One actuating shaft, of which one end projects into the open chamber 23, is positioned pivotably about the axis 22 in each suspension tube section 20, 20'. An actuating shaft 27 for the height adjustment of a chair is located in the suspension tube section 20 shown in FIG. 2, top, whereas an actuating shaft 28 for actuating a synchronous mechanism is positioned in the suspension tube section 20' shown in FIG. 2, bottom. Each actuating shaft 27, 28 has at least one driving pin 29 extending radially to the axis 22 and passing outwards through an oblong hole 30 in the respective suspension tube section 20 and 20'. The respective oblong hole 30 covers part of the circumference of the respective suspension tube section 20, 20', the circumferential extension of the respective oblong hole 30 simultaneously defining the maximum pivot angle of the actuating shaft 27 and 28, respectively, about the axis 22. FIG. 2 illustrates only one driving pin 29 and one oblong hole 20.

The pivoting of the actuating shafts 27, 28 is effected by means of an operating lever 31 having a plug-in socket 32 and an actuating handle 33 arranged on the latter. Prior to the assembly of the armrest 18 on the suspension tube 19—the tubular plug-in socket 32 is placed on the corresponding suspension tube section 20 and 20', respectively. Recesses 34 formed on the inside of the plug-in socket 32 engage with the driving pin 29. The configuration of the operating lever 31 is to be seen from FIG. 3. As seen in FIGS. 2 and 3, the actuating handle 33 projects on one side from the plug-in socket 32 referred to the axis 22. Since recesses 34 are formed on either side of the plug-in socket 32, the latter can be placed on the suspension tube section 20' such that the operating lever 31 projects outwards in the direction towards the armrest 18, as seen in FIG. 2, bottom. If—as seen in FIG. 2, top—no armrest 18 is to be provided, then the operating lever 31 can be placed on the suspension tube section 20 such that the actuating handle 33 projects in the direction towards the adjacent bearing bush 19. In this case, the front end of the respective suspension tube section 20 having the recesses 26 only has to be closed with a covering cap. As seen in FIG. 2, bottom, a portion of the respective suspension tube section 19 and 20 forming a bearing section 35 is left free between the respective bearing bush 19' and the adjacent plug-in socket 32. As still to be shown below, the seat 10 is being pivotably supported on these bearing portions.

Figure 4:
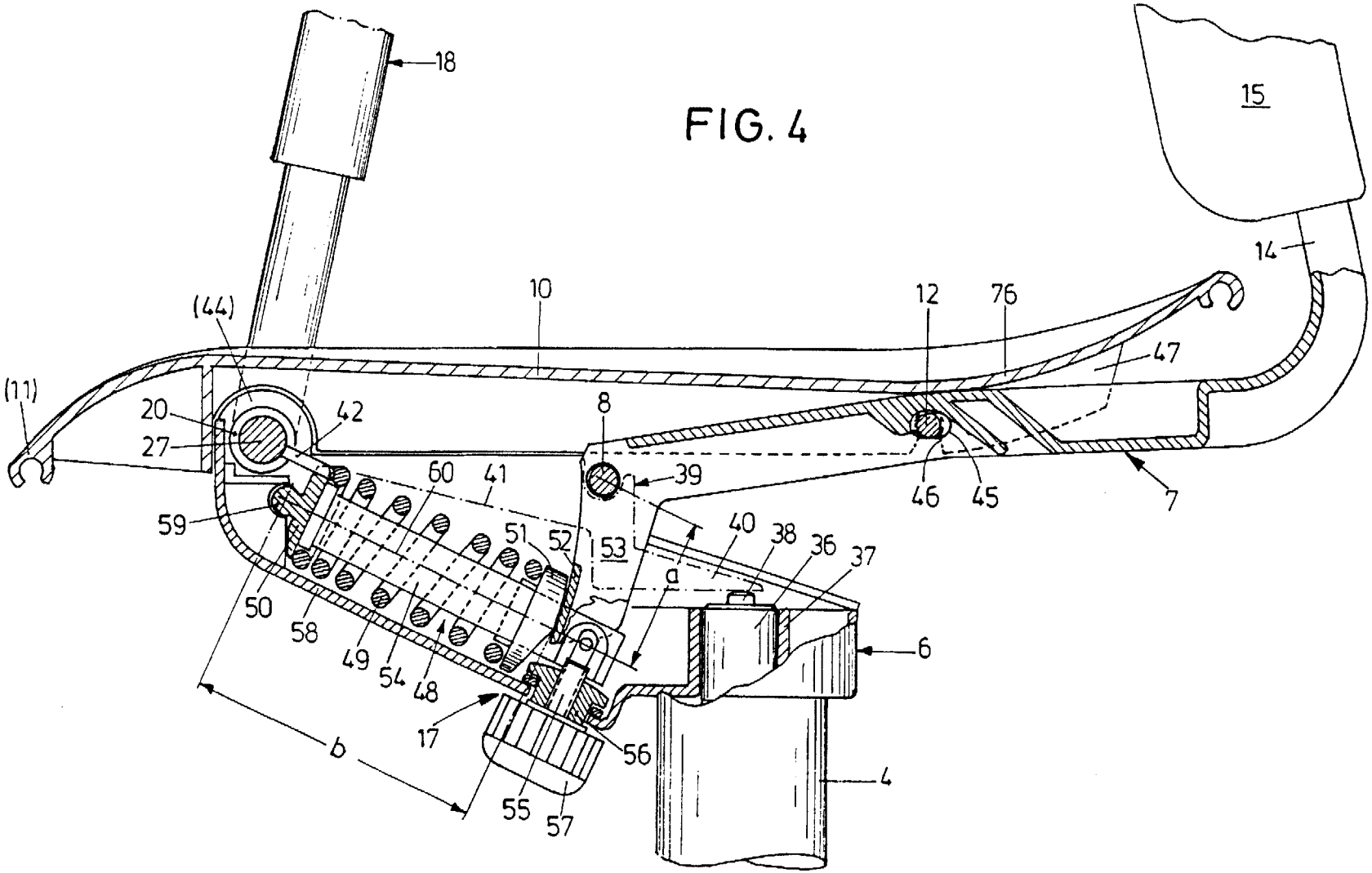
FIG. 4 is a partial vertical section through the chair in accordance with the line IV—IV of FIG. 2.

For the adjustment in height of the seat support 5 together with the seat 10 and the back 15, the chair column 4 has a longitudinally adjustable gas spring 36 generally known, which is clampingly retained in a clamping device 37 in the form of a cone, of the front seat support member 6. A valve control pin 38 projects upwards from the gas spring 36, which when pushed into the gas spring 36, opens a valve provided there, thereby ensuring longitudinal adjustments of the gas spring 36. Gas springs of this type are generally known in practice and have been shown and specified in U.S. Pat. No. 3,656,593. A two-armed valve control lever, which—as seen in FIG. 4—supports itself pivotably on the pivot axle 8, is provided for the actuation of this pin 38. One lever arm 40 of the lever 39 bears against the valve control pin 38, while the other lever arm 41 ends in the vicinity of the open chamber 23. This is where a valve control arm 42 projecting from the actuating shaft 27 approximately radially to the axis 22 is arranged on the actuating shaft 27 for the height adjustment of the seat, and that on the section of the actuating shaft 27 extending into the open chamber 23. The free end of the valve control arm 42 engages from below the adjacent free end of the lever arm 41, so that for any pivoting of the actuating shaft such that the free end 43 is pivoted upwards, the lever arm 40 of the lever 39 is pivoted downwards, pushing the valve actuating pin 38 into the gas spring 36. This pivoting operation is counterclockwise in FIG. 4. Whenever the user releases the actuating handle 33, the pin 38 is restored by the gas pressure in the gas spring 36, whereby the lever 39 and consequently the actuating shaft 27 are restored into the initial position.

As indicated above, the seat 10 is elastically locked in place on the suspension tube section 20, 20' by means of locking sections 44 which partially encase the bearing sections 35. This is feasible without any difficulty, the seat 10 and the locking sections 44 being made in one piece of hard elastic plastics. The locking sections 44 are shown in particular in FIG. 6. The rear portion of the seat 10 is supported on the supporting axle 12 which is positioned in oblong holes 45 extending approximately horizontally in the rear seat support member 7 and which extends in parallel to the axis 22 and to the pivot axle 8. The seat 10 is locked into place on this supporting axle 12 by means of snap-in holes 46 formed in webs 47 of the seat 10 extending downwards from the latter. Whenever the seat 10 is pivoted about the axis 22 of the front bearing sections 35 upon the pivoting of the rear seat support member 7 about the pivot axle 8, i.e. when the seat's rear portion is raised or lowered, then the oblong hole 45 in the rear seat support member 7 ensures the substantially horizontal relative motions occurring for any such raising or lowering, between the seat 10 and the rear seat support member 7 by the supporting axle 12 performing these motions in the oblong holes 45. When the rear seat support member 7 is pivoted about the pivot axle 8, the back 15 is pivoted in accordance with the pivoting motions of the rear seat support member 7. On the other hand, the seat 10 is pivoted about the stationary axis 22 by reason of the substantially vertical pivoting motions of the supporting axle 12 positioned in the rear seat support member 7. As a result of the geometric relations apparent from FIGS. 1, 4, 6, of the horizontal distances of the axis 22 relative to the pivot axle 8, to the supporting axle 22 and to the back-rest 15, the latter is pivoted by three to four times the angular measure as compared with the seat 10 when the rear seat support member is pivoted.

The pivoting described above, of the synchronous mechanism is encountered by an energy storing device 48, which is a prestressed helical compression spring 49 in the example of embodiment shown. By way of a pivotable abutment 50, this helical compression spring 49 supports itself on the front seat support member 6 under the actuation shaft 28 in the open chamber 23. The other end of the compression spring 49 is supported on guide shoe 51 of the force variation equipment 17. The guide shoe 51 rests on a slide face 52 formed on a lever arm 53 of the rear seat support member 7. This lever arm 53 is formed in one piece with the rear seat support member and extends from the pivot axle 8 substantially downwardly. In this regard, the rear seat support member is geometrically formed as an angle lever. The pivotable abutment 50 is provided with a rod 54 passing through the compression spring 49, on which also the guide shoe 51 is displaceable in the direction of the compression spring 49. The force variation equipment 17 engages on the end opposite to the abutment 50, of the rod 54. It has an adjusting screw 55 articulated on the rod 54 and engaging with an adjusting nut 56 which is configured as a part of a turning handle 57 and positioned rotatably but non-displaceably in the direction of the adjusting screw 55 in a lower wall 58 of the front seat support member 6. Consequently, upon rotation of the turning handle 57 with the adjusting nut 56, the adjusting screw 55 together with the rod 54 is pivoted on the pivot hinge 59, by way of which the pivotable abutment 50 supports itself on the front seat support member 6. Upon this, the guide shoe 51 is displaced on the sliding face 52 of the lever arm 53, whereby the distance of the axis 60 of the energy storing device 48 from the pivot axle 8 is changed. Since the sliding face 52 lies at least approximately on a segment of the arc of a circle, of which the center is formed by the pivot hinge 59, the distance b between the pivot hinge 59 and the point where the axis 60 passes through the slide face 52 is not or only slightly changed by rotation of the turning handle 57, so that the prestressing of the helical compression spring is not influenced by such adjustments.

So, the force exercised by the compression spring 49 on the lever arm 53 is not changed; it is only the effective lever arm, i.e. the overall torque exercised by the compression spring 49 on rear seat support portion 7 and thus on the seat and the back 15, that is changed by the modification of the distance a between the axis 60 and the pivot axle 8. This torque is the smaller, the smaller the distance a and vice versa. Thus, even the adjusting forces to be applied to the turning handle 57 can be kept constant along the entire adjusting path of the guide shoe 51, the frictional forces between the guide shoe 51 and the slide face 52 practically remaining unchanged.

A blocking mechanism 61 is provided to preclude the above-described pivotability of the seat 10 in common with the back 15 against the force of the compression spring 49. This blocking mechanism 61 substantially illustrated in FIGS. 2 and 5 has a blocking lever 62, which is arranged on the lever arm 53 of the rear seat support member 7 by means of a pivot joint 63 and which is pivotable about an axis parallel to the pivot axle 8. The pivot joint 63 is situated in the lower portion of the lever arm 53, i.e. it has a distinct distance from the pivot axle 8. On its bottom the blocking lever 62 is provided with a stop face 64 which is approximately perpendicular to the longitudinal direction of the blocking lever 62 and to which a stationary blocking face 65 is assigned. This blocking face 65 is formed on the front seat support member 6 in the vicinity of the latter's lower wall 58. The blocking face 65 faces the pivot joint 63, whereas the stop face 64 faces the blocking face 65. Opposite the pivot joint 63, the blocking lever 62 has a forked end 66, to which a blocking actuator arm 67 applies from below which is T-shaped and tightly joined to the actuating shaft 28. Consequently, a transverse web **67*a* of the actuator arm 67 engages the forked end 66 from below. From the section located in the open chamber 23, of the actuating shaft 27, the actuator arm 67 projects in the radial direction towards the axis 22. The blocking actuator arm 67 is pivoted from a postion shown in solid lines into a position shown in dash-dotted lines in FIG. 5 by the pivoting of this actuating shaft 28, which has been specified above for the actuating shaft 27. In the position shown in solid lines in FIG. 5, the blocking actuator arm 67 lifts the blocking lever 62 such that the latter's stop face 64 is disengaged from the blocking face 65. If the user of the chair forces the back 15 rearwards against the force of the compression spring 49, then the forked end 66 of the blocking lever 62 can be moved on the T-shaped actuator 67 in the direction towards the actuating shaft 27. Free balancing of the synchronous mechanism is possible. When, however, the actuating pin 28 is pivoted by means of the operating lever 31 into the position shown in dash-dotted lines in FIG. 5, then the transverse web 67*a* of the T-shaped actuator arm 67 is no longer in engagement with the forked end 66 so that the latter can slip over a guide pin 68 joined to the blocking face 65. However, this pivoting down of the blocking lever 62 is only possible when the rear seat support member 7 is pivoted by the force of the compression spring 49—the back 15 and the seat 10 being correspondingly relieved—into a position in which the back 15 takes its front end position and the seat 10 takes its upper end position. In these positions, the distance of the pivot joint 63 from the blocking face 65 is such as to allow the blocking lever 62 to move into a lower position of blocking shown in dash-dotted lines in FIG. 5. Therefore, any blocking of the rear seat support member 7 in relation to the front seat support member 6 and thus any fixing of the back 15 and the seat 10 in one position each is only possible in this specified position. When the relieved blocking lever 62 is moved essentially in its longitudinal direction by the pivoting of the rear seat support 7, then its bottom 69 slips over a support face 70 of the front seat support member 6 formed between the blocking face 65 and the guide pin 68**.

Figure 6:
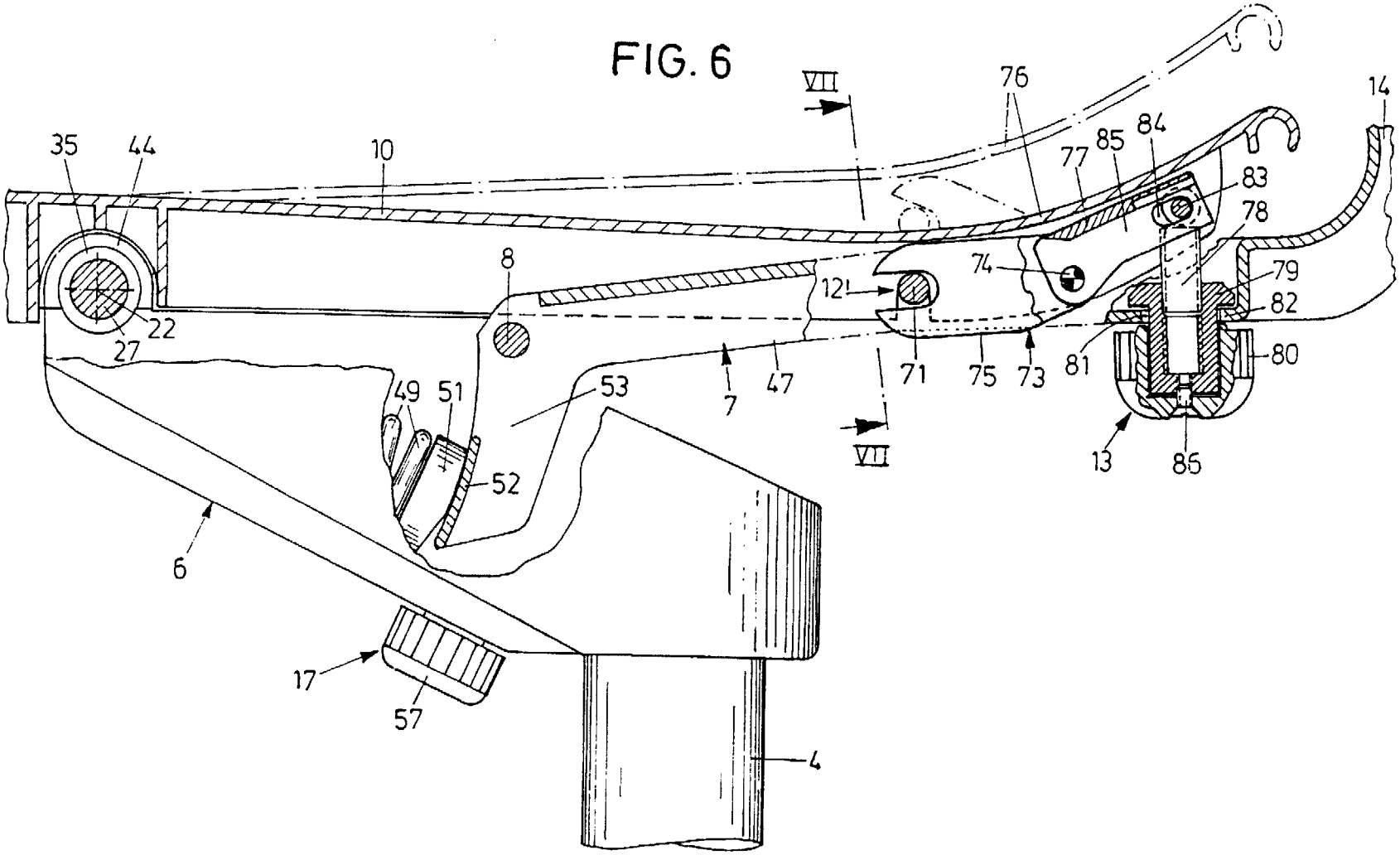
FIG. 6 is a partial vertical section through the seat of the chair, a seat pitch adjuster being illustrated.
Figure 7:
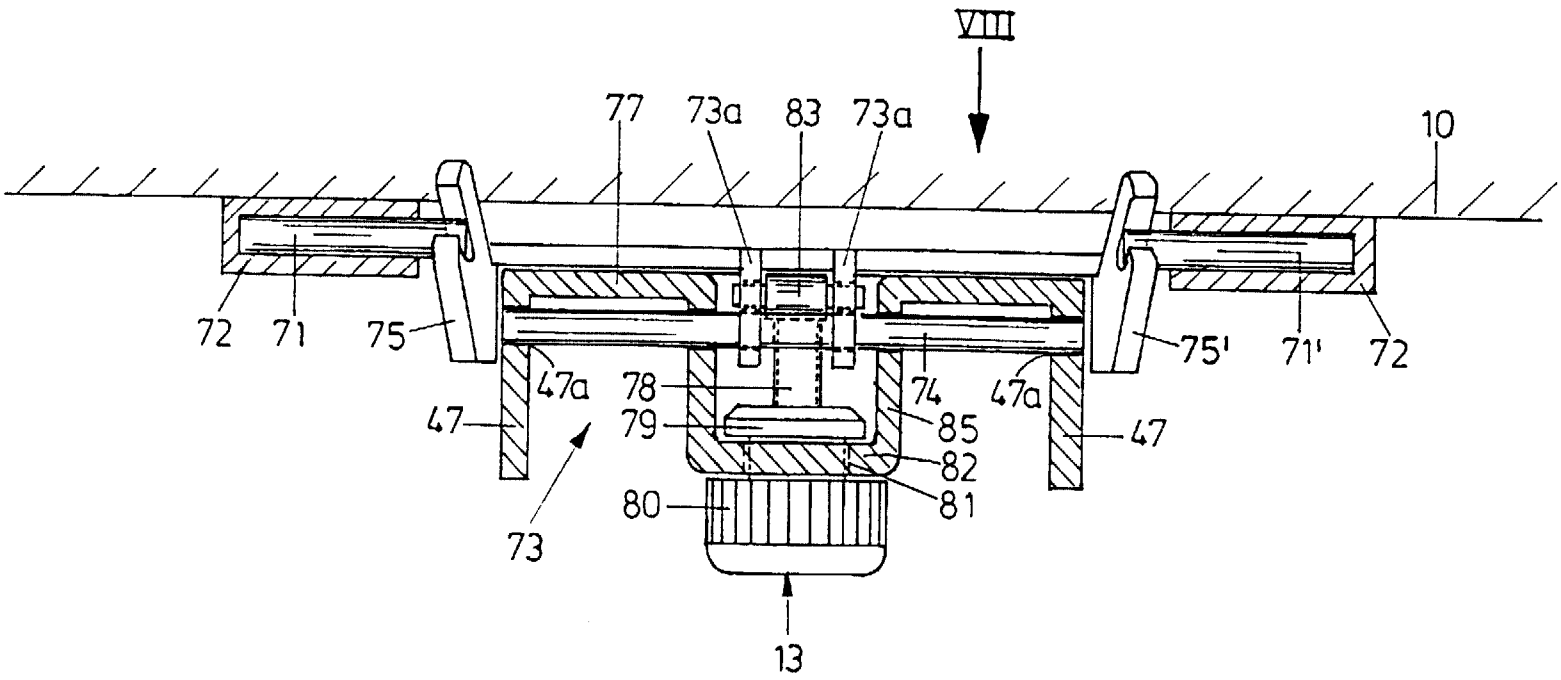
FIG. 7 is a partial vertical cross-section through the chair in accordance with the line VII—VII of FIG. 6.
Figure 8:
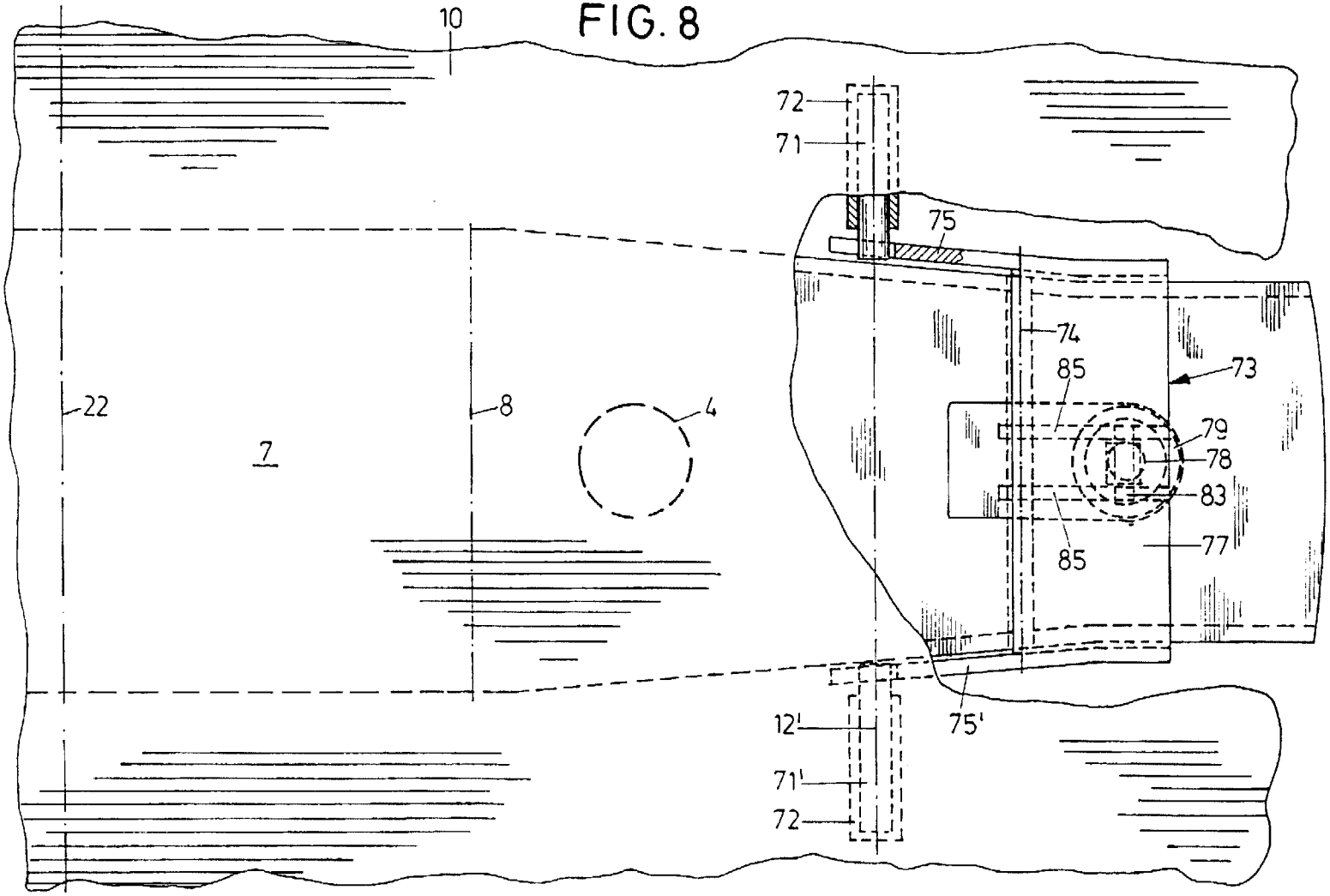
FIG. 8 is a partial plan view of the seat pitch adjuster in accordance with the arrow VIII of FIG. 7.

Unlike the support of the seat 10 by way of the supporting axle 12 which is substantially stationary referred to the rear seat support member 7, the basic adjustment of the seat pitch can also be varied by the possible alternative of a seat pitch adjuster 13 substantially shown in FIGS. 6 to 8. In this case, there is no continuous rod-shaped supporting axle 12, but the supporting axle 12' is fomed by two pins 71, 71' clampingly retained in bearing elements 72 on the bottom of the seat 10 so that they can be mounted even subsequently and, if necessary, removed without the seat 10 being destroyed. As seen in FIGS. 7 and 8, they are situated on either side of the rear seat support member 7 so that they can be pivoted past the latter's webs 47.

A balance 73 in the form of a double-armed lever is positioned on the seat support member 7 to be pivotable about a pivot axle 74. The pivot axle 74 is inserted into openings 47*a* in the webs 47 of the rear seat support member 7. It further passes through web-like bearing cheeks 73*a* formed on the bottom facing the rear seat support member 7, of the balance 73. The pivot axle 74 can be retained clampingly in the webs 47 and in the web-like bearing cheeks 73*a*, respectively. The balance 73 has two forked lever arms 75, 75' likewise located on either side of the rear seat support member 7 and gripping a pin 71 and 71', respectively, so that the pins 71, 71' vary in height when the balance 73 is pivoted about the pivot axle 74 parallel to the pivot axle 8. As a result, given an otherwise fixed position of the rear seat support member 7 relative to the front seat support member 6, i.e. without any simultaneous adjustment of the position of the back 15, the seat 10 is pivoted about the axis 22 so that its rear portion 76 takes a higher or lower position relative to the rear seat support member 7. This pivoting of the balance 73 is realized in a similar way as the pivoting of the compression spring 49 of the force variation equipment 17.

An adjusting screw 78 engaging with an adjusting nut 79 is articulated on the plate-shaped lever arm 77 opposite to the forked lever arms 75, 75', of the balance 73. The adjusting nut 79 is tightly joined to a turning handle 80 which together with the adjusting nut 79 is supported rotatably but non-displaceably in the direction of the adjusting screw 78 in an opening 81 of a wall 82 of the rear seat support member 7. On its end opposite to the adjusting nut 79, the adjusting screw 78 has a transverse web 83 engaging with oblong holes 84 of abutment webs 85 of the lever arm 77. Upon rotation of the turning handle 80 the adjusting screw 78 is screwed into or out of, the adjusting nut 79, which results in the balance 73 being correspondingly pivoted about the pivot axle 74, the lowermost basic adjustment of the seat 10 to be achieved in this way being shown in solid lines and the highest possible basic adjustment being shown in dash-dotted lines in FIG. 6.

When the seat pitch adjuster 13 is installed as a possible accessory part—subsequently, as the case may be—then the adjusting nut 79 is inserted from above through the opening 81 in the wall 82 and the turning handle 80 is placed from below; both parts are then assembled by means of a screw 86. Further, the pins 71, 71' are pushed or forced into the bearing elements 72. The balance 73 is joined to the rear seat support member 7 by the pivot axle 74 being inserted. Further, the supporting axle 12 is removed from the oblong holes 45. The pins 71, 71' are then inserted in the forked lever arms 75, 75'. Subsequently, the seat 10 is joined to the front suspension tube 9 in that the locking sections 44 elastically lock into place on the suspension tube sections 20, 20', on which they are pivotable about the axis 22. The dismantling takes place correspondingly.

What is claimed is:

1. A chair, in particular an office chair, comprising a pedestal (2)

a chair column (4) projecting upwards from the pedestal (2)

a seat support (5) supported on the chair column (4) and having a front seat support member (6) joined to the chair column (4) and a rear seat support member (7) joined to the front, seat support member (6) by way of a pivot axle (8)

a seat (10) pivotably supported on the seat support members (6, 7)

a back-rest (15) secured to the rear seat support member (7)

an energy storing device (48), of which one end is positioned on the front seat support member (6) by means of a pivot hinge (59) and of which the other end is pivotably supported on the rear seat support member (7) at a distance (a) from the pivot axle (8), and a blocking mechanism (61) for arresting the rear seat support member (7) in relation to the front seat support member (6), wherein the blocking mechanism (61) has a blocking lever (62) articulated on the rear seat support member (7) at a distance from the pivot axle (8) by means of a pivot joint (63) and provided with a stop face (64) which is pivotable into bearing engagement with a blocking face (65) stationary relative to the front seat support member (6) and releasable from this bearing engagement by means of a blocking actuator arm (67).

2. A chair according to claim 1, wherein the stop face (64) is turned away from the pivot joint (63) and the blocking face (65) faces the latter.

3. A chair according to claim 1, wherein the blocking lever (62) is pivotable upwards out of the bearing engagement of the stop face (64) with the blocking face (65).

4. A chair according to claim 1, wherein the blocking actuator arm (67) engages from below an end of the blocking lever (62) turned away from the pivot joint (63) to release the bearing engagement of the stop face (64) with the blocking face (65).

5. A chair according to claim 1, wherein the blocking actuator arm (67) is arranged on an actuating shaft (28) which is pivotably arranged in a suspension tube (9) supporting the seat (10) in the vicinity of a front edge (11) of the seat (10).

6. A chair according to claim 1, wherein the blocking actuator arm (67) is T-shaped with a transverse web (67*a*) engaging the blocking lever (62) from below.

7. A chair according to claim 6, wherein the blocking lever (62) has a forked end (66) which faces the blocking actuator arm (67) and with which the blocking actuator arm (67) engages.

8. A chair, in particular an office chair, comprising:

a pedestal (2);

a chair column (4) projecting upwards from the pedestal (2);

a front seat support (5,6) fixed to the chair column (4);

a rear seat support member (7) joined to the front seat support member (6) by a pivot axle (8);

a seat (10) pivoted on the front seat support member and supported on the rear seat support member (7);

a back-rest (15) secured to the rear seat support member (7);

an energy storing device (48), having a first end positioned on the front seat support member (6) by means of a pivot hinge (59) and having another end distal the first end pivotably supported on the rear seat support member (7) at a distance (a) from the pivot axle (8); and a blocking mechanism (61) for arresting the rear seat support member (7) in relation to the front seat support member (6);

wherein the blocking mechanism (61) has a blocking lever (62) articulated on the rear seat support member (7) at a pivot joint (63) spaced from the pivot axle (8), and provided with a stop face (65) stationary relative to the front seat support member (6), and releasable from bearing engagement with a blocking actuator arm (67).

* * * * *